US010576317B2

(12) United States Patent
Claessen et al.

(10) Patent No.: US 10,576,317 B2
(45) Date of Patent: Mar. 3, 2020

(54) EXTINGUISHING-FLUID-NOZZLE SYSTEM FOR STATIONARY FIRE-EXTINGUISHING SYSTEMS

(71) Applicant: Minimax GmbH & Co. KG, Bad Oldesloe (DE)

(72) Inventors: Thomas Claessen, Kaarst (DE); Maik Koehler, Bad Oldesloe (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 134 days.

(21) Appl. No.: 15/119,471

(22) PCT Filed: Nov. 19, 2014

(86) PCT No.: PCT/EP2014/074973
§ 371 (c)(1),
(2) Date: Aug. 17, 2016

(87) PCT Pub. No.: WO2015/124224
PCT Pub. Date: Aug. 27, 2015

(65) Prior Publication Data

US 2017/0007867 A1 Jan. 12, 2017

(30) Foreign Application Priority Data

Feb. 19, 2014 (DE) ..... 10 2014 203 043

(51) Int. Cl.
*A62C 31/03* (2006.01)
*A62C 99/00* (2010.01)

(52) U.S. Cl.
CPC ..... *A62C 31/03* (2013.01); *A62C 99/0027* (2013.01)

(58) Field of Classification Search
CPC ..... A62C 31/03; A62C 35/68; A62C 99/0027; A62C 99/0018; B05B 1/14; B05B 1/16;
(Continued)

(56) References Cited

U.S. PATENT DOCUMENTS 2,007,036 A * 7/1935 Cornell, Jr. ..... G01F 1/42 138/44
2,583,232 A * 1/1952 Russell ..... B05B 1/3006 239/109

(Continued)

FOREIGN PATENT DOCUMENTS

CN 103415328 A 11/2013
DE 24 55 364 A1 5/1976

(Continued)

OTHER PUBLICATIONS

Korean Notice of Preliminary Rejection dated Aug. 18, 2017 (KR10-2016-7025412), with English translation.

(Continued)

*Primary Examiner* — Darren W Gorman
*Assistant Examiner* — Joseph A Greenlund
(74) *Attorney, Agent, or Firm* — Perkins Coie LLP

(57) ABSTRACT

An extinguishing fluid nozzle system (1, 100, 200), for stationary fire extinguishing systems, with an extinguishing fluid nozzle having a main body (3, 104, 204) which has an inlet opening (23, 123, 223) and can be fixed in fluid-conducting relationship to an extinguishing fluid line, a nozzle head (5, 106, 206) which has one or more outlet openings (25, 125, 225) connected in fluid-conducting relationship to the inlet opening for the discharge of the extinguishing fluid, and an aperture (7, 107, 207) having an aperture ring (15, 115, 215) for flow limitation, arranged in the fluid path between the inlet opening and the one or more outlet openings. The aperture has a grip portion (17, 117, 217) which is fixedly connected to the aperture ring and which extends outwardly from the aperture ring and which in the fitted condition of the aperture extends outside the extinguishing fluid nozzle.

19 Claims, 3 Drawing Sheets

Figure 1:
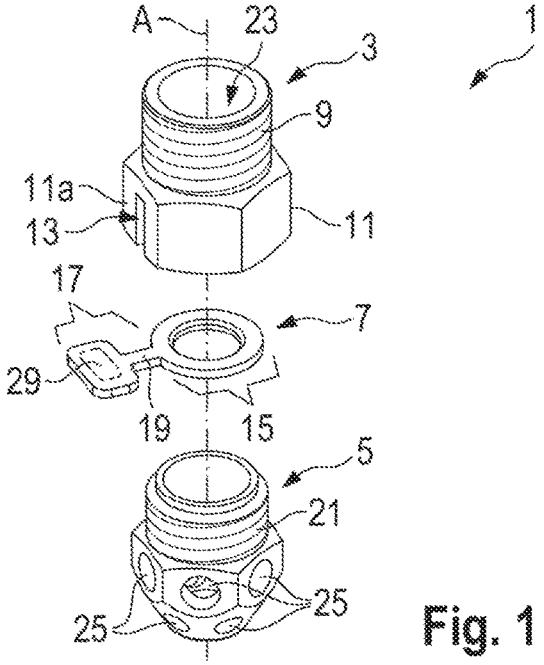

(58) Field of Classification Search
CPC ... B05B 1/1609; B05B 1/1627; B05B 1/1681; B05B 15/534; G01F 1/42
USPC ..... 169/16; 239/575, 580, 596, 600–601; 138/40–44
See application file for complete search history.

(56) References Cited

U.S. PATENT DOCUMENTS 2,661,768 A * 12/1953 Novak ..... F16L 1/11 138/44
2,707,489 A * 5/1955 Larkin ..... E21B 49/087 138/45
2,918,933 A * 12/1959 Boitnott ..... G05D 7/0146 137/502
3,788,484 A * 1/1974 Godin ..... B01D 29/012 210/447
4,116,386 A * 9/1978 Calder ..... B05B 15/534 239/119
4,422,339 A * 12/1983 Gall ..... G01F 1/42 138/44
4,503,594 A * 3/1985 Gall ..... G01F 1/42 138/41
4,508,268 A * 4/1985 Geberth, Jr. ..... B05B 15/534 239/119
4,750,370 A * 6/1988 Ossyra ..... G01F 1/42 73/861.61
5,123,628 A * 6/1992 Yu ..... E03C 1/021 138/42
5,280,853 A * 1/1994 Perret, Jr. ..... B05B 15/534 239/119
5,340,029 A * 8/1994 Adams ..... B05B 15/534 239/119
5,421,274 A * 6/1995 Gordon ..... F23K 3/02 110/232
5,423,580 A * 6/1995 Mohlenkamp ..... F16J 15/061 285/379
5,887,793 A * 3/1999 Kieffer ..... B05B 15/534 239/119
5,893,522 A * 4/1999 Kieffer ..... B05B 15/534 239/600
6,155,284 A * 12/2000 Scantlin ..... F16K 17/042 137/624.27
6,264,115 B1 * 7/2001 Liska ..... B05B 15/534 239/119
6,425,410 B1 * 7/2002 Taylor ..... F16K 17/406 137/467
6,481,640 B1 * 11/2002 Carey ..... B05B 9/01 239/119
6,557,782 B1 * 5/2003 Urra ..... B05B 7/2462 239/302
6,719,212 B1 * 4/2004 Leisi ..... B05B 15/534 239/119
7,497,772 B2 * 3/2009 Laib ..... F16L 41/082 138/44
8,025,080 B2 * 9/2011 Orleskie ..... G01F 1/42 138/44
8,365,765 B2 * 2/2013 Bell ..... G01F 1/42 137/551
8,601,668 B2 * 12/2013 Vidrine ..... B25B 27/0028 277/609
9,062,510 B1 * 6/2015 Cassel ..... F16K 37/0008
2007/0102535 A1 * 5/2007 Carey ..... B05B 15/534 239/74
2008/0060449 A1 * 3/2008 Darsey ..... G01F 1/40 73/861.65
2011/0120737 A1 * 5/2011 Flynn ..... A62C 31/02 169/90
2012/0097772 A1 * 4/2012 Drozd ..... B05B 7/0815 239/590
2013/0180614 A1 * 7/2013 Pila Gonzalez ..... F16K 3/0272 138/44
2013/0292141 A1 * 11/2013 Senecal ..... A62C 31/05 169/37
2017/0007867 A1 * 1/2017 Claessen ..... A62C 31/03

FOREIGN PATENT DOCUMENTS

| | | | |
|---|---|---|---|
| DE | 43 42 912 | A1 | 6/1995 |
| DE | 44 39 798 | C2 | 10/1996 |
| FR | 2719487 | A1 | 11/1995 |
| FR | 2719487 | B1 | 7/1996 |
| JP | S56-54378 | A | 5/1981 |
| JP | H04-307191 | A | 10/1992 |
| JP | 2003-322289 | A | 11/2003 |
| KR | 10-1284870 | B1 | 7/2013 |
| KR | 10-1324321 | B1 | 11/2013 |
| WO | 2007/073390 | A1 | 6/2007 |
| WO | 2011/127595 | A1 | 10/2011 |
| WO | 2012/091712 | A1 | 7/2012 |

OTHER PUBLICATIONS

English translation of Japanese Office Action dated Jun. 13, 2017.
Chinese Office Action dated Aug. 9, 2018 with English translation (corresponding to CN201480075993.7).

* cited by examiner

EXTINGUISHING-FLUID-NOZZLE SYSTEM FOR STATIONARY FIRE-EXTINGUISHING SYSTEMS

CROSS-REFERENCE TO RELATED APPLICATIONS

This application is a National Stage of International Application No. PCT/EP2014/074973, filed Nov. 19, 2014, which claims priority to German Application No. 102014203043.9, filed Feb. 19, 2014. The entire disclosures of each of the above applications are incorporated herein by reference.

FIELD

The disclosure concerns an extinguishing fluid nozzle system which is, in particular, an extinguishing gas nozzle system for stationary fire extinguishing systems, with an extinguishing fluid nozzle having a main body which has an inlet opening and can be fixed in fluid-conducting relationship to an extinguishing fluid line, a nozzle head which has one or more outlet openings connected in fluid-conducting relationship to the inlet opening for the discharge of the extinguishing fluid, and comprising an aperture having an aperture ring for flow limitation, arranged in the fluid path between the inlet opening and the one or more outlet openings.

BACKGROUND AND SUMMARY

Stationary fire extinguishing systems are basically known. The essential function of such fire extinguishing systems is monitoring rooms or entire buildings for the occurrence of a risk of fire. When registering the occurrence of a fire the know fire extinguishing systems are adapted to deliver extinguishing agents such as for example an extinguishing fluid from an extinguishing fluid source through a suitably designed distribution network to the location of the risk of fire or the actual fire and there discharge it from suitably designed extinguishing fluid nozzles. In that respect there are various possible options in terms of the structure of the extinguishing fluid nozzles themselves. An essential endeavour in terms of parametrisation of such extinguishing systems is the targeted discharge, with the greatest possible effectiveness, of the extinguishing fluid in the direction of the seat of the fire. In most cases the seats of fires are where the greatest risk of a fire occurring has also already been previously assumed to be the case so that most extinguishing nozzles have further directing means to discharge extinguishing fluid on to such potential sources of fire in targeted fashion.

Particular but not exclusive focus of the disclosure was on fire extinguishing systems with extinguishing fluids like for example carbon dioxide, argon, nitrogen or mixtures of the above-mentioned gases, and with chemical extinguishing fluids like for example HFC 227ea or FK5-1-12. When using such extinguishing fluids, it is important for the extinguishing process to succeed that distribution of the extinguishing fluid occurs in accordance with the geometry of the protected area. Besides the geometrical orientation of the nozzles however the amount of extinguishing agent discharged by the nozzles is also an important matter. The specific flow quantity of the extinguishing fluid discharged from each nozzle is usually adapted to the respective situation of use, insofar as disposed in a flow path in the interior of the extinguishing nozzles are aperture openings in the form of bores of reduced size (in comparison with the other internal cross-section in the fluid path of the nozzle body). Nozzle types are also known, in which annular aperture members are installed.

A fire extinguishing system by way of example having an extinguishing agent nozzle in which an annular aperture has been installed is shown in DE 44 39 798 C2.

DE 24 55 364 A1 discloses a sprinkler installation with a plurality of sprinklers at differing heights, wherein throttle apertures are arranged at least in some branch pipes of the sprinkler installation or at the inlets thereof upstream of the sprinklers.

U.S. Pat. No. 2,918,933 A discloses a throttle for flow limitation or volume limitation in a line portion, in which a grip portion extends outwardly from a fitment, with which the flow limitation can be adjusted by means of a screw thread.

DE 43 42 912 A1 discloses a spray head with a housing which has a connection for the water feed and in which is disposed a carrier element carrying a spray plate with water outlet nozzles, wherein provided on the carrier element is a throttle body cooperating with a tubular valve member for determining the quantitative through-flow rate per unit of time. The valve member there is in the form of a sleeve and is arranged displaceably in the housing with an adjusting device, wherein the downstream-disposed region is of an enlarged configuration so that the inside diameter of the enlarged region corresponds to the outside diameter of the region of the sleeve, that is mounted in the housing.

WO 2007/073390 A1 discloses a pressure relief valve for pressurised gas for suppressing fire, which operates in a two-stage self-regulating mode. The valve includes a valve body, a plunger and a plug, as well as a valve actuator and a plunger actuator. The plunger is moveable within the valve housing along an axis between a first and a second position. The plug is moveable within the valve body along that axis between a closed valve position, a partly opened position and a completely opened position. The valve actuator makes it possible for the plug to move from the closed into the partially opened position. The plunger actuator moves the plunger from the first position into the second position when a gas pressure in the gas cylinder remains below a reference value. When the plunger moves into the second position the plunger enables the plug to change from the partly opened position into the completely opened position.

The known fire extinguishing systems are frequently used in buildings in which the space conditions change in the course of time, for example because installations disposed in the rooms or storage articles are put into store, changed or removed. It can also happen that parts of the fire extinguishing system are updated and modified, for example in regard also to the extinguishing agents used. In such cases adaptation of the extinguishing fluid nozzles is also required, which in the known systems takes up a great deal of time and is linked to structural involvement. That has proven to be a disadvantage. A further disadvantage encountered in the state of the art is that, after fitment of an aperture into a nozzle, whether by installing an aperture ring or by introducing one or more aperture bores, it is subsequently no longer readily possible to ascertain the inside diameter of the aperture. The result of this for example can be that nozzles have to be removed and re-fitted, the removal of which would not have been at all necessary, because the aperture diameter was appropriate to the new purpose of use. Likewise it can happen that nozzles are not removed and replaced by fresh nozzles, although the aperture diameter in the nozzles is no longer suitable for the new purpose of use.

Therefore the object of the disclosure is to improve an extinguishing fluid nozzle system of the kind set forth in the opening part of this specification, such that adaptation of the system to changing conditions of use is simplified.

The aperture has a grip portion which is fixedly connected to the aperture ring and which extends outwardly from the aperture ring and which in the fitted condition of the aperture extends outside the extinguishing fluid nozzle. That grip portion provided on the aperture ensures that, even when the aperture is installed in the extinguishing fluid nozzle, it is still possible to see from the exterior what kind of an aperture is fitted as the grip portion is visible from the exterior. It is now readily possible for the grip portion to be provided with an identification element for a characteristic feature like for example the respectively associated inside diameter of the aperture. In that way the risk of incorrect associations of given aperture sizes for the respective purpose of use of the extinguishing fluid nozzle is markedly minimised.

In accordance with a particularly preferred development of the disclosure the extinguishing fluid nozzle has an introduction opening passing therethrough for receiving the aperture, wherein the introduction opening extends from an inside of the extinguishing fluid nozzle to an outside at the periphery of the extinguishing fluid nozzle. In that way it is possible for the extinguishing fluid nozzle to be equipped with an aperture through the introduction opening or for an aperture to be removed from the extinguishing fluid nozzle through the introduction opening without the entire extinguishing fluid nozzle having to be removed from its location of use, and this entails a significant reduction in the fitment complication and expenditure and thus a saving of time upon first assembly, in maintenance of such extinguishing fluid nozzle systems.

In a particularly preferred embodiment according to the disclosure the dimensions of the introduction opening correspond to the dimensions of an introduction portion of the grip portion of the aperture, which introduction portion extends in the fitted condition through the introduction opening. That ensures that the aperture sits with a small amount of play and preferably in play-free fashion with its introduction portion in the introduction opening and no unwanted loosening or shifting of the aperture in the extinguishing fluid nozzle occurs.

In a further preferred embodiment of the disclosure the introduction opening extends sideways at an angle relative to a longitudinal direction of the extinguishing fluid nozzle, preferably transversely relative to the longitudinal direction. Preferably in that case the inside dimensions of the introduction opening are matched to the outside dimensions of the aperture ring and the introduction portion such that the aperture can be introduced sideways into the extinguishing fluid nozzle by being pushed and can be removed sideways from same by being pulled. In other words the aperture is pushed into or pulled out of the extinguishing fluid nozzle with a guillotine-like movement from the side, which involves particularly simple handling when changing the aperture.

In an alternative preferred embodiment of the disclosure the introduction opening extends in the direction of the longitudinal axis of the extinguishing fluid nozzle as far as an end of that body in which it is fitted, being therefore for example the main body or the nozzle body. In this embodiment therefore the introduction opening is "open" towards one side in the longitudinal direction of the extinguishing fluid nozzle. In that respect it is preferred if the width of the introduction portion of the aperture transversely relative to the longitudinal direction of the extinguishing fluid nozzle is less than the width of the aperture ring transversely relative to the longitudinal direction of the extinguishing fluid nozzle. In other words the introduction portion in the transverse direction of the extinguishing fluid nozzle is narrower than the aperture ring accommodated in the extinguishing fluid nozzle. In other words the introduction opening is preferably in the form of a slot open at one side in the manner of a sliding guide structure.

Preferably in this embodiment the inside dimensions of the introduction opening are matched to the outside dimensions of the introduction portion in such a way that the aperture can be introduced into the extinguishing fluid nozzle in the direction of the longitudinal axis by being pushed. The expression "inside dimensions" is used to denote the dimensions in the longitudinal and transverse direction of the extinguishing fluid nozzle. That embodiment, after introduction of the aperture or prior to removal of the aperture, admittedly entails fixing of the aperture by means of closure of the hitherto "open" end of the introduction opening. In exchange however the comparatively smaller introduction opening, in a direction transversely relative to the longitudinal axis of the extinguishing fluid nozzle, already affords a safeguard against unwanted lateral removal of the aperture.

Preferably the aperture is secured in the introduced condition by means of a nut screwed on the outside on to the main body or the nozzle head. Further preferably provided at the height of the aperture (with respect to the longitudinal direction of the extinguishing fluid nozzle) is a clamping element, for example in the form of a clamping ring, which embraces the main body or the nozzle head and additionally secures the aperture to prevent rotation thereof. Particularly preferably the aperture has one or more recesses matched to the clamping element, into which the clamping element extends. The foregoing design configurations are particularly preferred in relation to an extinguishing fluid nozzle system in which the nozzle head and the main body are in one piece. It is however also possible for the nozzle head and the main body to be of a multi-part nature.

In a preferred configuration the nozzle head is reversibly releasably coupled to the main body, preferably by means of a screw connection, wherein the aperture in the introduced condition thereof is connected to the main body in force-locking and/or positively locking relationship, preferably by means of screwing the nozzle head to the main body. The term reversible releasability is used in that respect to mean in particular that it is possible to carry out a number of separations and re-connections of the connecting means in non-destructive fashion.

In a preferred configuration of the extinguishing fluid nozzle system according to the disclosure, as indicated above, arranged on the grip portion on at least one surface and preferably on two opposite surfaces is a respective identification element, in particular selected from the list consisting of: an optically and/or haptically perceptible identification element, a machine-readable identification element or combinations thereof. Examples of optically and/or haptically perceptible identification elements are for example printed markings, inscriptions, engravings, embossings, stamped-out markings or milled-out markings and application of material. Examples of machine-readable identification elements are for example barcodes, RFID tags or the like encoded information. The identification elements can be applied for example using fluorescent or phosphorescent dyes to improve readability.

The disclosure will be described by means of the foregoing preferred embodiments of the overall system with reference to the interplay between the extinguishing fluid nozzle and the aperture member fitted therein. The disclosure is reflected however not just in the system comprising the combination of those elements, but also in the two individual elements.

In a further aspect the disclosure thus concerns an aperture for an extinguishing fluid nozzle, in particular an extinguishing gas nozzle for stationary fire extinguishing systems, in a system according to one of the above-described preferred embodiments, with an aperture ring for flow limitation, which can be arranged in a fluid path between an inlet opening and one or more outlet openings of the extinguishing fluid nozzle, wherein the aperture has a grip portion which is fixedly connected to the aperture ring and which extends outwardly from the aperture ring and which in the fitted condition of the aperture extends outside the extinguishing fluid nozzle. The aperture is preferably developed in accordance with the above-described configurations relating to the extinguishing fluid nozzle system, for which reason in this respect attention is directed in their full entirety to the foregoing description.

In a further aspect the disclosure therefore also concerns an extinguishing fluid nozzle, in particular an extinguishing gas nozzle for an extinguishing fluid nozzle system, according to one of the above-described preferred embodiments, in particular comprising a main body which has an inlet opening and which can be fixed in fluid-conducting relationship to an extinguishing fluid line, and a nozzle head which has one or more outlet openings connected in fluid-conducting relationship to the inlet opening for discharge of the extinguishing fluid, wherein the extinguishing fluid nozzle is adapted to receive an aperture according to one of the above-described preferred embodiments, in particular comprising an aperture ring for flow limitation which can be arranged in the fluid path between the inlet opening and the one or more outlet openings, which has a grip portion which is fixedly connected to the aperture ring and which extends outwardly from the aperture ring and which in the fitted condition of the aperture extends outside the extinguishing fluid nozzle.

In regard also to the advantageous developments of the extinguishing fluid nozzle according to the disclosure reference is directed in their full entirety to the features of the above-described extinguishing fluid system according to the disclosure.

DRAWINGS

Figure 2A:
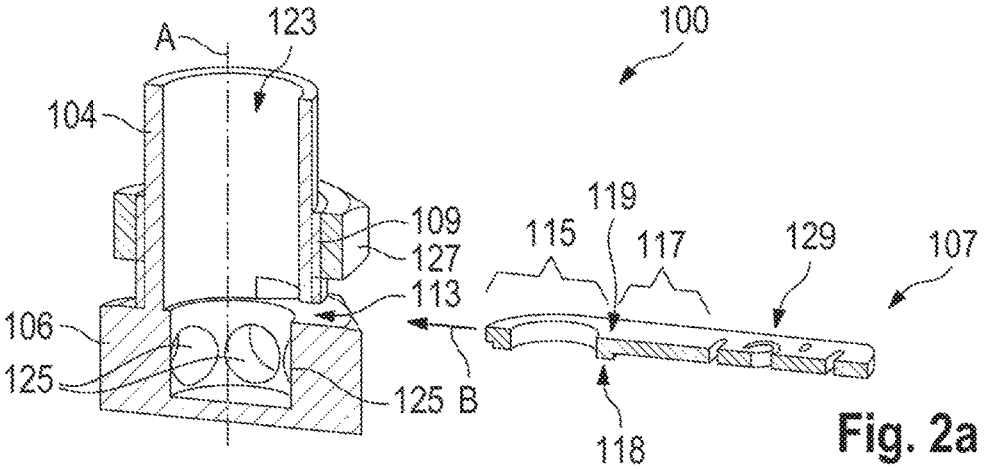
Figure 2B:
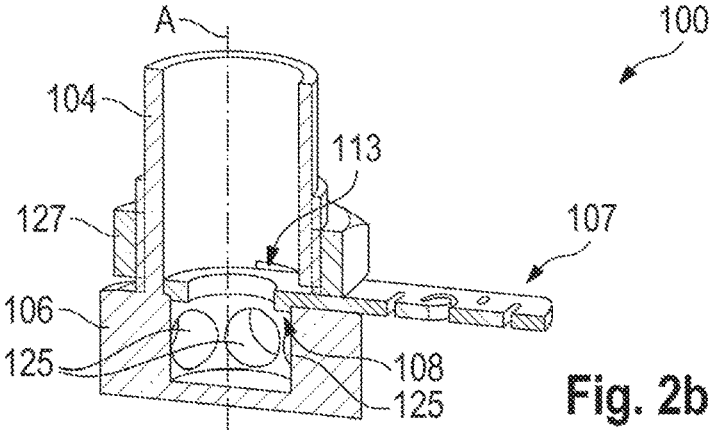
Figure 3A:
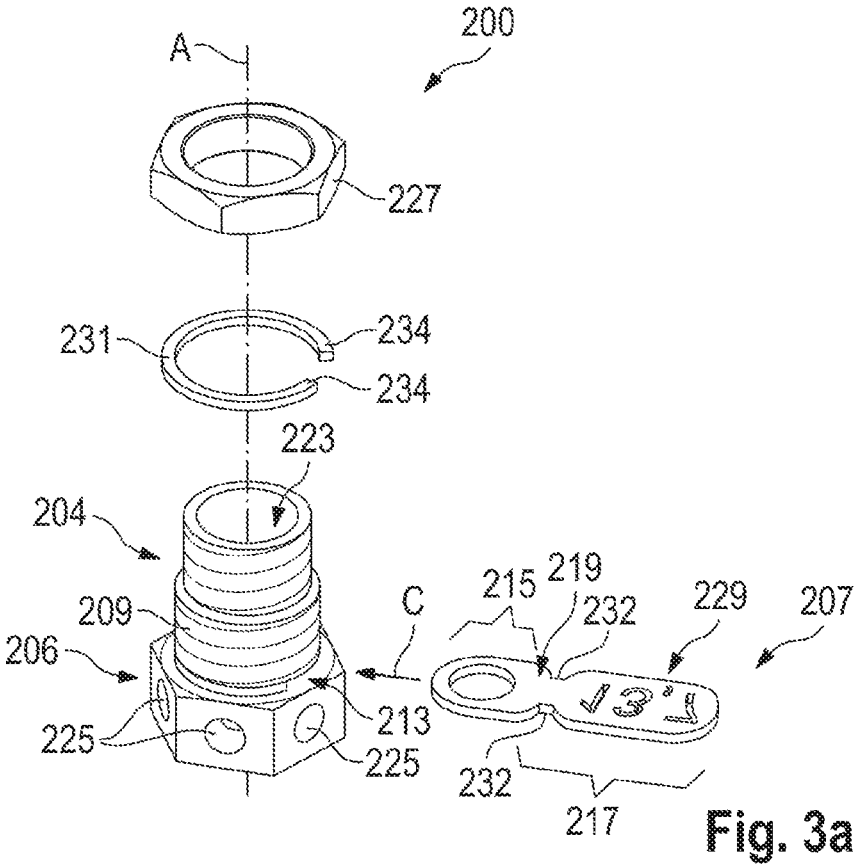
Figure 3B:
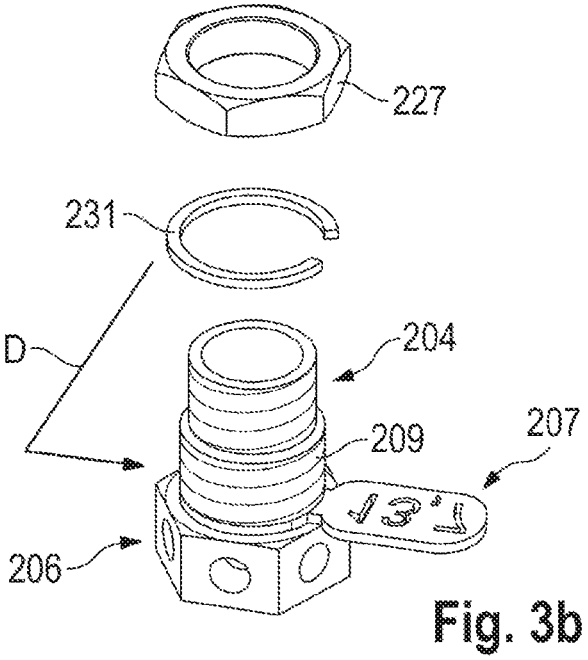
Figure 3C:
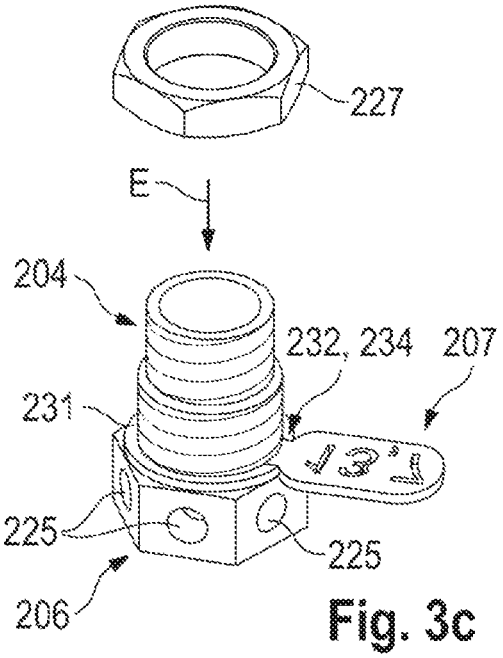
Figure 3D:
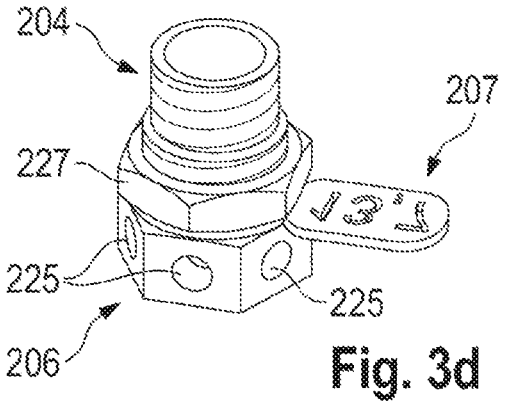
Figure 3E:
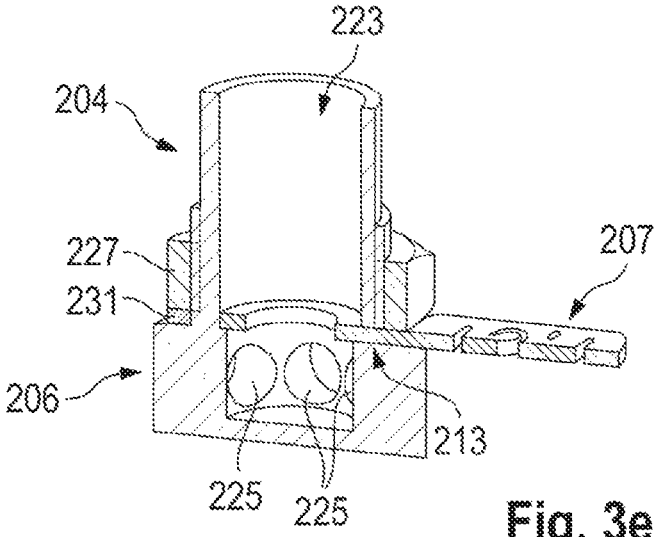

The disclosure is described in greater detail hereinafter with reference to the accompanying Figures by means of a plurality of preferred embodiments by way of example. In the drawing:

FIG. 1 shows a diagrammatic exploded perspective view of an extinguishing fluid nozzle system according to a first embodiment, FIG. 2*a* shows a diagrammatic cross-sectional view of an extinguishing fluid nozzle system according to a second embodiment in a first condition, FIG. 2*b* shows the extinguishing fluid nozzle system of FIG. 2*a* in a second condition, FIG. 3*a* shows a diagrammatic exploded view of an extinguishing fluid nozzle system according to a third embodiment in a first condition, FIG. 3*b* shows the system of FIG. 3*a* in a second condition, FIG. 3*c* shows the system of FIGS. 3*a* and *b* in a third condition, FIG. 3*d* shows the system of FIGS. 3*a-c* in a fourth condition, and FIG. 3*e* shows the system of FIGS. 3*a-d* in a fifth condition.

DETAILED DESCRIPTION

FIG. 1 shows an extinguishing fluid nozzle system 1 according to a first preferred embodiment of the disclosure. The extinguishing fluid nozzle system 1 has a main body 3 which can be reversibly releasably connected to the nozzle head 5. An aperture 7 can be arranged between the main body 3 and the nozzle head 5.

In a peripheral portion which is an upper portion in FIG. 1 the main body 3 has a male thread 9. At a lower portion in FIG. 1 the main body 3 has a hexagonal profile portion 11. Provided in a side surface 11*a* of the periphery of the main body 3 is an introduction opening 13 which extends from the inner peripheral surface to the outer peripheral surface and extends in the longitudinal direction of the axis A. The introduction opening 13 is open at an end of the main body 3, which is the lower end in FIG. 1.

The aperture 7 has an aperture ring 15 adapted for introduction into the interior of the extinguishing fluid nozzle. The aperture ring 15 is of a smaller inside diameter than the rest of the interior in the fluid path of the extinguishing fluid nozzle system 1. That inside diameter serves to limit the flow cross-section within the extinguishing fluid nozzle.

The aperture 7 has a grip portion 17 extending radially outwardly from the aperture ring 15. In turn the grip portion 17 has an introduction portion 19 whose width transversely relative to the direction of the axis A is reduced and corresponds to the width of the introduction opening 13 transversely relative to the direction of the axis A. The grip portion 17 has an identification element 29.

To introduce the aperture 7 into the extinguishing fluid nozzle of the extinguishing fluid nozzle system 1 the nozzle head 5 which has a male thread 21 is screwed out of the thread arranged in the interior of the hexagonal profile portion 11. Then by aligning the introduction portion 19 with the introduction opening 13 and subsequently pushing the aperture 7 along the introduction opening 13 into the main body 3 the aperture 7 can be moved into position. Subsequently the nozzle head 5 is screwed into the main body 3 again. Fluid which now passes into the main body 3 through an inlet opening 23 is impeded in its flow through the aperture ring 15 of the aperture 7, that is to say the flow cross-section is limited before it issues from a or a plurality of outlet openings 25 from the nozzle head 5.

In the present embodiment the grip portion 17 is shown without characterisation with an identification element or elements. However a characterisation in accordance with an embodiment of the disclosure can be readily placed on the part of the grip portion 17, that is disposed outside the introduction portion 19.

FIGS. 2*a* and *b* show a further embodiment of the disclosure. Shown here is an extinguishing fluid system 100 having a main body 104 which is one piece with a nozzle head 106. An introduction opening 113 is provided in the main body 104 towards one side transversely relative to the axis A. The introduction opening 13 is of a slot-shaped configuration and is adapted to receive an aperture 107. The aperture 107 is substantially the same in its function as the aperture 7 in FIG. 1, insofar it has an aperture ring 115 adapted to limit the flow cross-section within the extinguishing fluid nozzle. The grip portion 117 of the aperture 107 is of the same width as the outside diameter of the aperture ring 115. Thus both the aperture ring 115 and also the introduction portion 117 are adapted to the width of the introduction opening 113. The nozzle head 106 has a plurality of outlet openings 125.

The aperture 107 can be pushed into the main body 104 laterally, transversely relative to the direction of the longitudinal axis A, in the direction of the arrow B. That condition is shown in FIG. 2*b*. To prevent unintended removal of the aperture 107 from the main body 104 or the nozzle head 106 this embodiment shown in FIGS. 2*a* and *b* has a securing nut 127 on a male thread 109 on the main body 104. As shown in FIG. 2*b* the securing nut 127, after introduction of the aperture 107, is screwed against same and simultaneously secures and seals the introduction opening 113.

In the example shown in FIGS. 2*a* and *b* the aperture 107, at the side thereof which is downward in the Figures, has an annular step 118 which supports the aperture 107 against a corresponding shoulder 108 in the nozzle head 106. Thus the aperture is secured in both force-locking and also positively locking relationship in the illustrated condition.

In addition as shown in FIGS. 2*a* and *b* the aperture 107 has a characterisation in the form of an identification element 129. In the present case the identification element 129 is in the form of an opening passing therethrough.

Finally FIGS. 3*a-e* show a third embodiment of the disclosure. Shown there is an extinguishing fluid nozzle system 200 which again has a one-piece structure consisting of the main body 204 and the nozzle head 206. Provided in the main body 204 is an introduction opening 213 which is oriented transversely relative to the axis A and which performs substantially the same function as the introduction opening 113 in the embodiment of FIGS. 2*a, b*. In this respect attention is directed to the foregoing description. A male thread 209 is provided at an outside peripheral surface. A clamping element 231 is provided between the male thread 209 and the nozzle head 206 at the height of the introduction opening 213. The male thread 209 is designed to receive a securing nut 227. The nozzle head 206 has a plurality of outlet openings 225.

At its grip portion 217 the aperture 207 used in the fluid nozzle system 200 has two recesses 232 for receiving ends 234 of a corresponding configuration of the clamping element 231. A characterization in the form of an optical identification element 229 is applied to the portion, shown at the right in the Figures, of the grip portion 217. FIG. 3*a-e* show by way of example the assembly sequence for introducing the aperture 207 into the extinguishing fluid nozzle of the extinguishing fluid nozzle system 200.

Firstly, starting from the condition shown in FIG. 3*a*, the aperture 207 is moved in the direction of the arrow C and introduced into the introduction opening 213 of corresponding configuration. After complete introduction, shown in FIG. 3*b*, the clamping element is moved at the height of the aperture 207 as indicated by the arrow D, pushed on to the nozzle head 206 and embraces same in such a way that the end portions 234 engage into the recesses 232 in the aperture 207, see the condition shown in FIG. 3*c*.

Then, for further fixing and sealing off the introduction opening 213, the securing nut 227 is screwed in the direction of the arrow E on to the male thread 209 until it has moved into the end position shown in FIG. 3*d*. In cross-section that gives the configuration shown in FIG. 3*e*.

To remove the aperture 207 from the extinguishing fluid nozzle system 200 shown in FIGS. 3*a-e* the above-described steps are performed in the reverse sequence.

As can be seen from the foregoing description the disclosure provides a system for efficient aperture change in extinguishing fluid nozzle systems. The simple characterization option on the grip portions of the apertures is a further possible way of increasing efficiency and avoiding errors.

The invention claimed is:

1. An extinguishing gas nozzle system for stationary fire extinguishing systems comprising an extinguishing fluid nozzle and an aperture, the extinguishing fluid nozzle having:

a main body which has an inlet opening and can be fixed in fluid-conducting relationship to an extinguishing fluid line, and a nozzle head which has one or more outlet openings connected in fluid-conducting relationship to the inlet opening for discharge of an extinguishing fluid, and the aperture having:

an aperture ring for flow limitation, arranged in a fluid path between the inlet opening and the one or more outlet openings, and a grip portion which is fixedly connected to the aperture ring and which extends outwardly from the aperture ring and which in a fitted condition of the aperture extends outside the extinguishing fluid nozzle, wherein an outer perimeter of the aperture ring is clamped within the extinguishing fluid nozzle, and wherein the nozzle head has a circumferential wall disposed about a longitudinal axis of the extinguishing fluid nozzle and a terminal wall transverse to the longitudinal axis of the extinguishing fluid nozzle and the one or more outlet openings of the nozzle head include a plurality of outlet openings disposed about the circumferential wall of the nozzle head.

2. An extinguishing nozzle system according to claim 1 wherein the extinguishing fluid nozzle has an introduction opening passing therethrough for receiving the aperture, wherein the introduction opening extends from an inside of the extinguishing fluid nozzle to an outside at the periphery of the extinguishing fluid nozzle.

3. An extinguishing gas nozzle system according to claim 2 wherein the dimensions of the introduction opening correspond to the dimensions of an introduction portion of the grip portion of the aperture, which introduction portion extends in the fitted condition through the introduction opening.

4. An extinguishing nozzle system according to claim 2 wherein the introduction opening extends sideways at a transverse angle relative to the longitudinal axis of the extinguishing fluid nozzle.

5. An extinguishing nozzle system according to claim 4 wherein inside dimensions of the introduction opening are matched to outside dimensions of the aperture ring and the introduction portion such that the aperture can be introduced sideways into the extinguishing fluid nozzle by being pushed.

6. An extinguishing nozzle system according to claim 2 wherein the introduction opening extends in a direction of the longitudinal axis of the extinguishing fluid nozzle as far as an end of the main body or the nozzle head.

7. An extinguishing gas nozzle system according to claim 6 wherein a width of an introduction portion of the aperture transversely relative to the longitudinal axis of the extinguishing fluid nozzle is less than the width of the aperture ring transversely relative to the longitudinal axis of the extinguishing fluid nozzle.

8. An extinguishing gas nozzle system according to claim 7 wherein inside dimensions of the introduction opening are matched to outside dimensions of the introduction portion in such a way that the aperture can be introduced into the extinguishing fluid nozzle in the direction of the longitudinal axis by being pushed.

9. An extinguishing nozzle system according to claim 1 wherein the aperture is clamped in the fitted condition by a nut screwed externally on to the main body or the nozzle head.

10. An extinguishing nozzle system according to claim 9 wherein a clamping element embraces the main body or the nozzle head and additionally secures the aperture to prevent rotation thereof.

11. An extinguishing gas nozzle system according to claim 10 wherein the aperture has recesses which are matched to the clamping element and into which the clamping element extends.

12. An extinguishing nozzle system according to claim 1 wherein the nozzle head and the main body are formed in one piece.

13. An extinguishing gas nozzle system according to claim 1 wherein the nozzle head is reversibly releasably coupled to the main body by a screw connection, wherein the aperture in the fitted condition thereof is connected to the main body in force-locking and/or positively locking relationship by screwing the nozzle head to the main body.

14. An extinguishing gas nozzle system according to claim 1 wherein arranged on the grip portion on at least one surface is a respective identification element selected from the list consisting of:

an optically and/or haptically perceptible identification element, a machine-readable identification element, or a combination thereof.

15. An extinguishing gas nozzle system according to claim 1 wherein the grip portion has an introduction portion adjacent the aperture ring, the introduction portion having an introduction width transverse to the axis and sized for receipt in an introduction opening of the extinguishing fluid nozzle, and an identification element adjacent the introduction portion, the identification element having an element width transverse to the axis that is greater than the introduction width of the introduction portion.

16. An extinguishing fluid nozzle system according to claim 1, wherein the terminal wall of the nozzle body comprises a closed end proximate the terminal wall.

17. An extinguishing fluid nozzle system according to claim 1, wherein the aperture ring for flow limitation comprises first and second generally planar surfaces with a single flow aperture extending therethrough from the first generally planar surface to the second generally planar surface along an axis.

18. An extinguishing fluid nozzle system, consists of:

an extinguishing fluid nozzle, having:

a main body which has an inlet opening and which can be fixed in fluid-conducting relationship to an extinguishing fluid line, and a nozzle head which has one or more outlet openings connected in fluid-conducting relationship to the inlet opening for discharge of an extinguishing fluid, and an aperture ring for flow limitation which can be arranged in a fluid path between the inlet opening and the one or more outlet openings, which has a grip portion which is fixedly connected to the aperture ring and which extends outwardly from the aperture ring and which in a fitted condition of the aperture extends outside the extinguishing fluid nozzle, wherein an outer perimeter of the aperture ring is clamped within the extinguishing fluid nozzle.

19. An extinguishing nozzle system having an extinguishing gas nozzle for stationary fire extinguishing systems, the extinguishing gas nozzle, comprising:

a main body defining an inlet opening and a nozzle receiving opening along a longitudinal axis, the main body having a peripheral portion including an upper portion proximate the inlet opening and a lower portion proximate the nozzle receiving portion, the upper portion being configured for fixation in fluid-conducting relationship to an extinguishing fluid line, and the lower portion having a longitudinal introduction opening extending along the longitudinal axis as far as an end of the lower portion of the main body;

a nozzle head disposed in the nozzle receiving opening of the main body, the nozzle head having at least one outlet opening connected in fluid-conducting relationship with the inlet opening of the main body for discharge of an extinguishing fluid, and an aperture that limits flow between the inlet opening and the one or more outlet openings, wherein the aperture has a grip portion which is fixedly connected to an aperture ring, the grip portion extending outwardly from the aperture ring and through the longitudinal introduction opening to outside the main body when an outer perimeter of the aperture ring is clamped between the main body and the nozzle head.

* * * * *